US007532163B2

(12) United States Patent
Chang et al.

(10) Patent No.: US 7,532,163 B2
(45) Date of Patent: May 12, 2009

(54) CONFORMAL ELECTRONICALLY SCANNED PHASED ARRAY ANTENNA AND COMMUNICATION SYSTEM FOR HELMETS AND OTHER PLATFORMS

(75) Inventors: Ike Y. Chang, Santa Monica, CA (US); Richard W. Nichols, Manhattan Beach, CA (US); Clifton Quan, Arcadia, CA (US); Jonathan D. Gordon, Hermosa Beach, CA (US); Irwin L. Newberg, Pacific Palisades, CA (US)

(73) Assignee: Raytheon Company, Waltham, MA (US)

( * ) Notice: Subject to any disclaimer, the term of this patent is extended or adjusted under 35 U.S.C. 154(b) by 200 days.

(21) Appl. No.: 11/705,213

(22) Filed: Feb. 13, 2007

(65) Prior Publication Data

US 2008/0191950 A1 Aug. 14, 2008

(51) Int. Cl.
*H01Q 1/38* (2006.01)

(52) U.S. Cl. ..... 343/700 MS; 343/718; 343/767

(58) Field of Classification Search ..... 343/700 MS, 343/718, 767

See application file for complete search history.

(56) References Cited

U.S. PATENT DOCUMENTS

| | | | | | |
|---|---|---|---|---|---|
| 3,845,389 | A * | 10/1974 | Phillips et al. | ..... | 455/90.3 |
| 4,284,991 | A * | 8/1981 | Dupressoir | ..... | 343/725 |
| 4,587,524 | A * | 5/1986 | Hall | ..... | 343/729 |
| 5,281,960 | A | 1/1994 | Dwyer, III | | |
| 5,493,305 | A | 2/1996 | Wooldridge et al. | | |
| 5,886,667 | A * | 3/1999 | Bondyopadhayay | . | 343/700 MS |
| 6,097,335 | A | 8/2000 | Cassen et al. | | |
| 6,630,905 | B1 | 10/2003 | Newberg et al. | | |
| 6,810,293 | B1 | 10/2004 | Chou et al. | | |
| 6,847,336 | B1 | 1/2005 | Lemelson et al. | | |
| 7,006,039 | B2 | 2/2006 | Miyamoto et al. | | |
| 7,170,446 | B1 | 1/2007 | West et al. | | |
| 2003/0062464 | A1 | 4/2003 | Byren et al. | | |
| 2005/0206583 | A1 | 9/2005 | Lemelson et al. | | |
| 2008/0030404 | A1 * | 2/2008 | Irwin et al. | ..... | 342/372 |

* cited by examiner

*Primary Examiner*—Tho G Phan
(74) *Attorney, Agent, or Firm*—Leonard A. Alkov

(57) ABSTRACT

A phased array antenna adapted to be mounted in a helmet. In the illustrative embodiment, the antenna comprises a substrate and an array of radiating elements disposed on said substrate, each of the elements including a-resonant cavity and a mechanism for feeding the cavity with an electromagnetic signal., The cavity is formed in a multi-layer structure between a ground plane and a layer of metallization. A radiating slot or slots are provided in the layer of metallization. A first layer of dielectric material is disposed within the cavity. The feed mechanism is a microstrip feed disposed in the first layer of dielectric material parallel to a plane of a portion of the substrate over which an associated element is disposed. A layer of foam is disposed between the layer of dielectric material and the ground plane. Second and third parallel layers of dielectric material are included in each element. The second layer is disposed adjacent to the ground plane. A layer of element interconnection circuitry is disposed between the second and third layers of dielectric material. A transmit/receive module or circuitry for each element is secured to the third layer of dielectric material. The substrate may be conformal or conformable, as well as rigid. An arrangement is included for steering a beam transmitted or received by the antenna.

16 Claims, 4 Drawing Sheets

CONFORMAL ELECTRONICALLY SCANNED PHASED ARRAY ANTENNA AND COMMUNICATION SYSTEM FOR HELMETS AND OTHER PLATFORMS

BACKGROUND OF THE INVENTION

1. Field of the Invention

The present invention relates to antennas and communication systems. More specifically, the present invention relates to electronically scanned phased array antennas and communication systems in which such antennas are used.

2. Description of the Related Art

The requirements for portable personal communication systems, particularly for military applications, continue to increase over time. From World War II to the Viet Nam war, the need was met by a communication system carried by a soldier, i.e. a 'radio man' with a large backpack. These systems typically required a large antenna and forced many tradeoffs in performance, weight, compactness, and reliability.

Current and future military requirements have forced the communication systems to evolve and to a considerable extent, radio systems developers have responded. However, the antenna has not evolved. Consequently, the antenna remains large and, inasmuch as these antennas are typically implemented as a dipole or a monopole antenna, these antennas do not allow for the directional control needed for high-performance in other applications.

For example, soldiers typically require a compact, non-intrusive means to carry an antenna to communicate. Antennas carried by soldiers are generally omni-directional antennas or do not provide any electronic steering to provide gain. Most current instances of soldier-carried antennas are monopole or dipole antennas mounted on radios inside backpacks. Soldier-carried directional antennas are typically dishes that must be mounted on a stationary surface and cannot operate while the soldier is moving or walking. Recent advances have made miniature patch or spiral antennas embedded in bullet-proof vests worn by soldiers, but such antennas do not have electronic beam-steering capabilities. Other proposals have had patch antennas embedded inside helmets, but these proposed antennas, while having some gain, do not offer electronic beam steering capabilities.

Thus, a need remains in the art for a system or method for improving the performance of conventional portable personal communication systems.

SUMMARY OF THE INVENTION

The need in the art is addressed by the teachings of the present invention. In a most general implementation, the invention is an antenna and comprises a substrate and an array of radiating elements disposed on said substrate, each of the elements including a radiating structure and a mechanism for feeding the radiating structure with an electromagnetic signal.

In the illustrative embodiment, the radiating structure is formed in a multi-layer structure between a ground plane and a layer of metallization. A radiating slot is provided in the layer of metallization. A first layer of dielectric material is disposed within the radiating structure. In the illustrative embodiment, the feed mechanism is a microstrip feed disposed in the first layer of dielectric material parallel to a plane of a portion of the substrate over which an associated element is disposed. A layer of foam is disposed between the layer of dielectric material and the ground plane. Second and third parallel layers of dielectric material are included in each element. The second layer is disposed adjacent to the ground plane. A layer of element interconnection circuitry is disposed between the second and third layers of dielectric material. A transmit/receive module for each element is secured to the third layer of dielectric material. The inventive system may be implemented to transmit or receive a beam with either linear or circular polarization; or any desired, polarization ratio.

The substrate is conformal or conformable. Hence, in the illustrative application, the phased array antenna is disposed within or upon a helmet. In the best mode, the antenna is optimized for a helmet constructed of Kevlar. In any case, a beam steering arrangement is included as is common in the phased array antenna art. Additional embodiments using planar substrate sections are envisioned

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
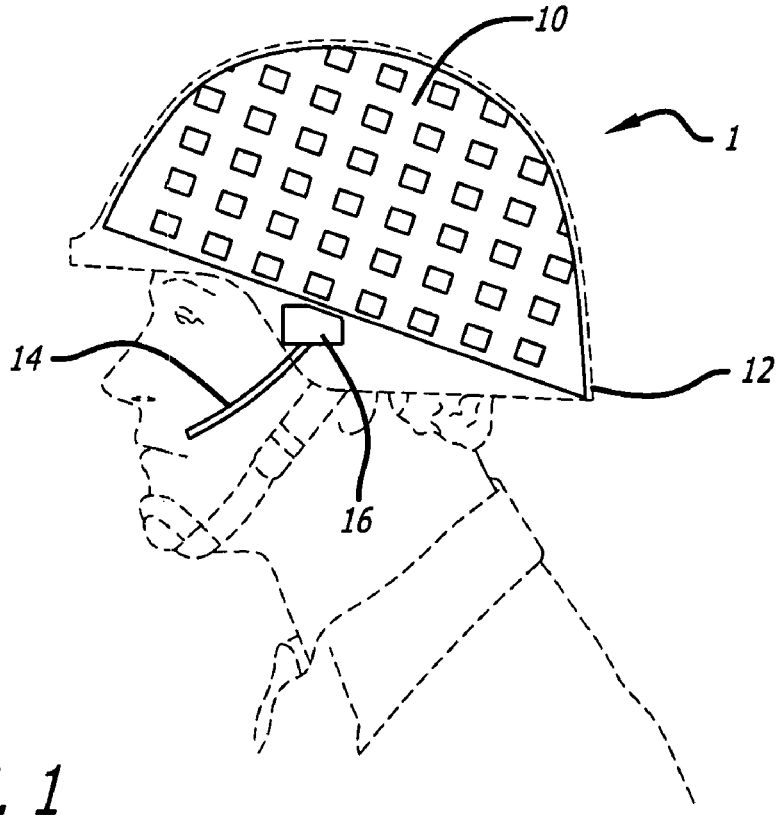
FIG. 1 is a side view of a helmet fitted shown in phantom with a communication system having a phased array antenna in accordance with an illustrative embodiment of the present teachings on a soldier shown in phantom.

FIG. 1 is a side view of a helmet 12 shown in phantom and fitted with a communication system 1 having a phased array antenna 10 in accordance with an illustrative embodiment of the present teachings on a soldier shown in phantom. In accordance with the present teachings, the phased array antenna 10 is conformal to the shape of the helmet. Hence, the helmet acts as a radome and thereby enhances the operation of the antenna with respect to the variety of tilt angles that may be anticipated by a soldier in an operational environment. Alternately, the antenna may be disposed on the outside of the helmet.

Figure 2:
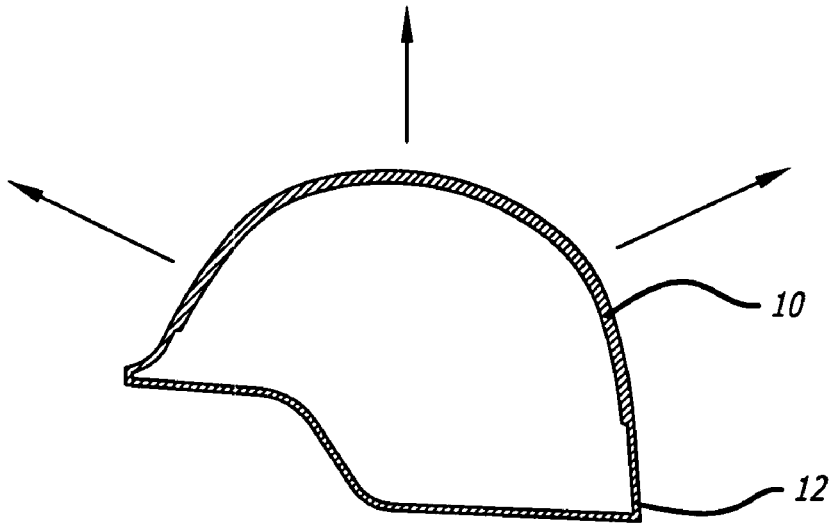
FIG. 2 is a sectional side view of the helmet of FIG. 1.

FIG. 2 is a sectional side view of the system depicted in FIG. 1. As shown in FIGS. 1 and 2, the phased array antenna 10 is secured inside the helmet and coupled to a communications module 16. The module 16 provides input and output interfacing to a microphone 14 and speakers or earphones (not shown). As shown in FIG. 2, the antenna 10 is secured within the helmet in a fixed orientation. In the best mode, the phased array antenna is built into the helmet for a thinner and more lightweight construction.

Figure 3:
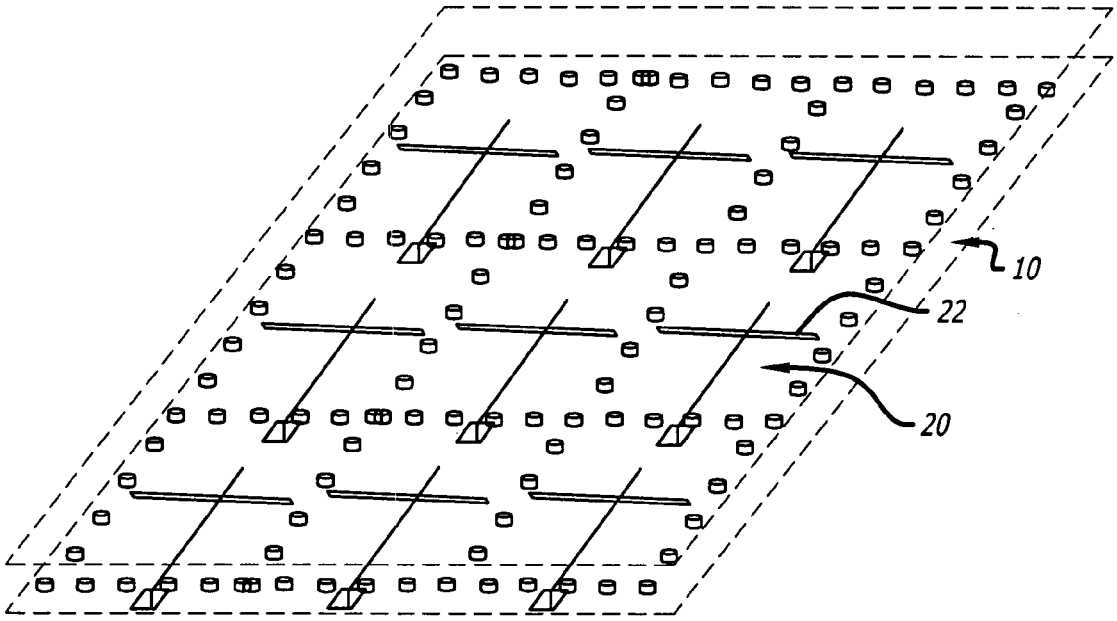
FIG. 3 is a perspective view of the phase array antenna depicted in FIGS. 1 and 2.

FIG. 3 is a perspective view of the phase array antenna depicted in FIGS. 1 and 2. In FIG. 3, the antenna array 10 is shown as an illustrative 3×3 array of radiating elements 20. Other array sizes and dimensions may be used without departing from the present teachings. As discussed more fully below, each element 20 is a multi-layer structure with a radiating slot 22 from which electromagnetic energy is transmitted and received on the selective activation thereof. Multiple linear and/or non-linear slots may be implemented at each element.

Figure 4:
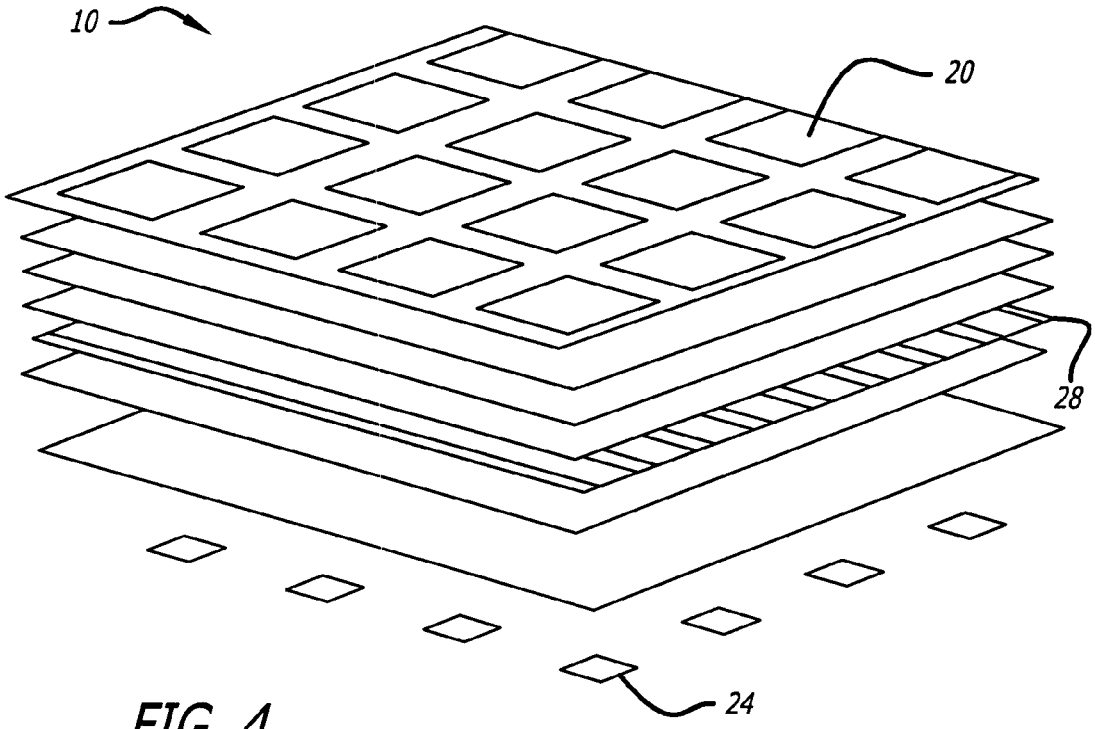
FIG. 4 is a multilayer view of the antenna of FIG. 3 in disassembled relation.

FIG. 4 is a multilayer view of the antenna of FIG. 3 in disassembled relation. As discussed more fully below, the multi-layer arrangement is effective to provide a radiating structure and signal routing for each slot in a thin, lightweight construction. The use of z-axis adhesive films, and T/R chips is a typical, but not restrictive, implementation.

Figure 5:
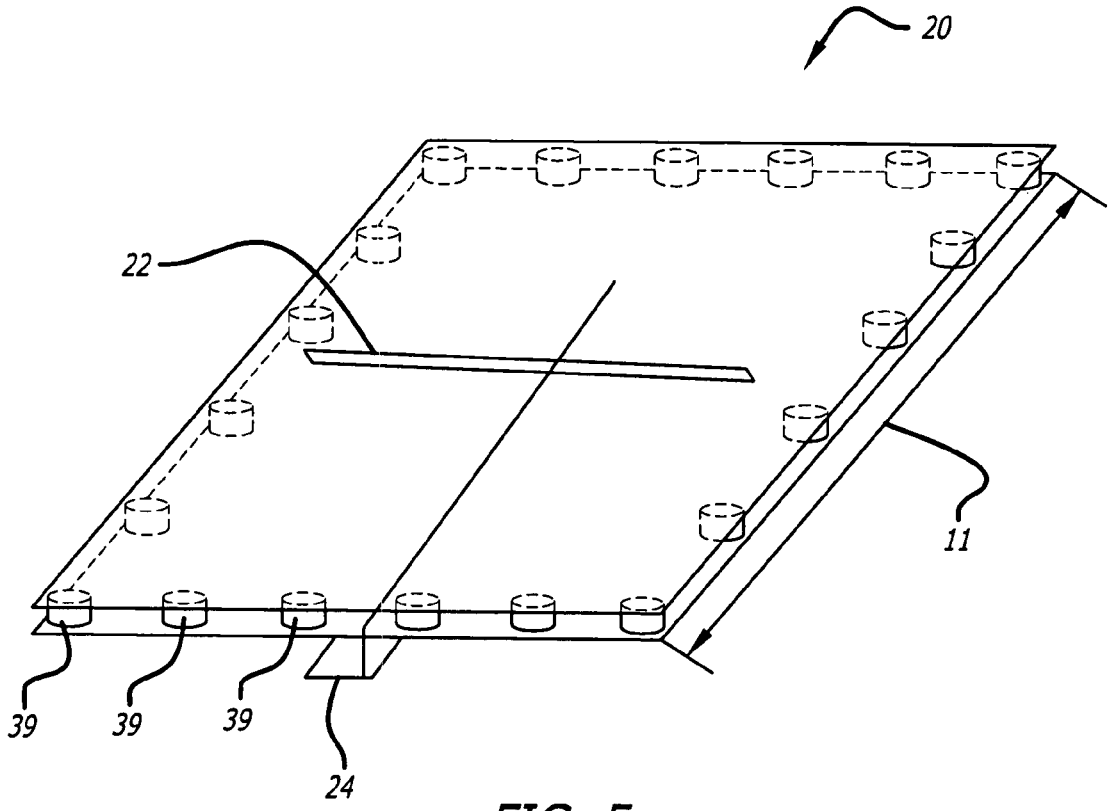
FIG. 5 is a perspective view of a single element of the phase array antenna depicted in FIG. 3.

FIG. 5 is a perspective view of a single element of the phase array antenna depicted in FIG. 3.

Figure 6:
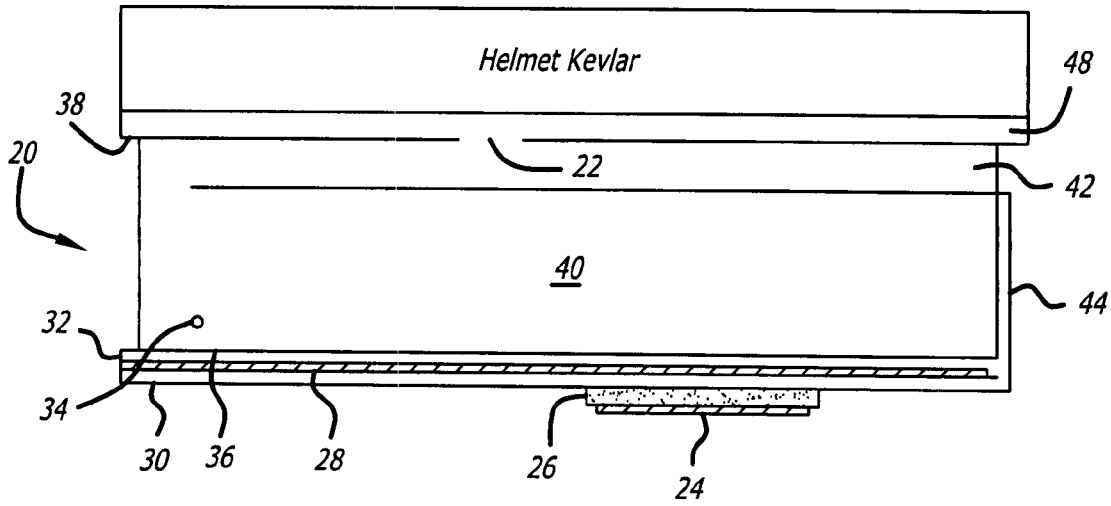
FIG. 6 is a sectional side view of a single element of the phase array antenna depicted in FIG. 3.

FIG. 6 is a sectional side view of a single element of the phase array antenna depicted in FIG. 3.

As illustrated in FIGS. 4-6, each element 20 includes a monolithic microwave integrated circuit (MMIC) transmit and receive module 24. The MMIC 24 may be of conventional design and construction or may be replaced with discrete circuit elements. As is common in the art, the MMIC modules include high power low noise amplifiers, phase shifters and switches to effect selective activation of the elements. Such MMIC T/R modules may be acquired from any of several vendors including Raytheon, IBM and MA-COM by way of example.

Each module 24 is secured to a respective element 20 via a conventional carrier 26. Signals to and from the module 24 and power therefor are communicated via one or more power and signal planes 28 through a first layer of dielectric material 30. In the illustrative embodiment, the element includes multiple layers of dielectric material. The multi-layer structure allows for provision of multiple cavities with a thin design that may be fabricated at tight tolerances with relative ease from a manufacturing perspective. In any event, the carrier 26 is bonded to the first layer with an epoxy, glue or other suitable adhesive. The power and signal layer 28 is sandwiched between the first layer of dielectric material 30 and a second layer of dielectric material 32.

Next, a radiating structure composed of a resonant cavity 34 is provided between a ground plane 36 and an upper layer of metallization 38. In the illustrative embodiment, the upper layer of metallization is a thin layer of foil. The resonant cavity 34 is 0.7 mils thick, the elements are 3 inches square and the slots thereof are spaced at 0.5 λ, where λ is the wavelength at the operating frequency $f_o$ of the system 10. In the illustrative application, the operating frequency $f_o \approx 1.6$ gigahertz.

As best illustrated in FIG. 5, the cavities are supported vertically by a plurality of element isolating posts or beads 39. In the illustrative embodiment, the posts 39 are made of metal such as solder and are spaced at 0.1 λ at the operating frequency of the antenna. At this spacing and the illustrative operating frequency of 1.6 gigahertz, the posts 39 provide a cage that effectively contains the electromagnetic radiation therein.

Each resonant cavity 34 is filled with an ultra-thin foam spacer 40. A third layer 42 of dielectric material is positioned between the foam spacer 40 and the metal (e.g. copper) upper surface 38 of the resonator cavity 34.

A strip of conductive material e.g. copper 44 couples energy from a respective TR module 24 into the cavity 34 to effect an excitation thereof. This strip 44, may be implemented with a microstrip line and is coupled to the module 24 through a jumper 48. Energy at the resonant frequency communicates with the cavity via the radiating slot 20 provided in the metal upper surface of the resonator 34.

A second layer of foam 48 is secured between the third dielectric layer 42 and the helmet 12 with a conventional epoxy.

FIG. 6 depicts the invention disposed on the inside of the helmet. The phase array antenna invention may be disposed on the outside of a helmet, as well as on planar surfaces without departing from the scope of the present teachings.

Figure 7:
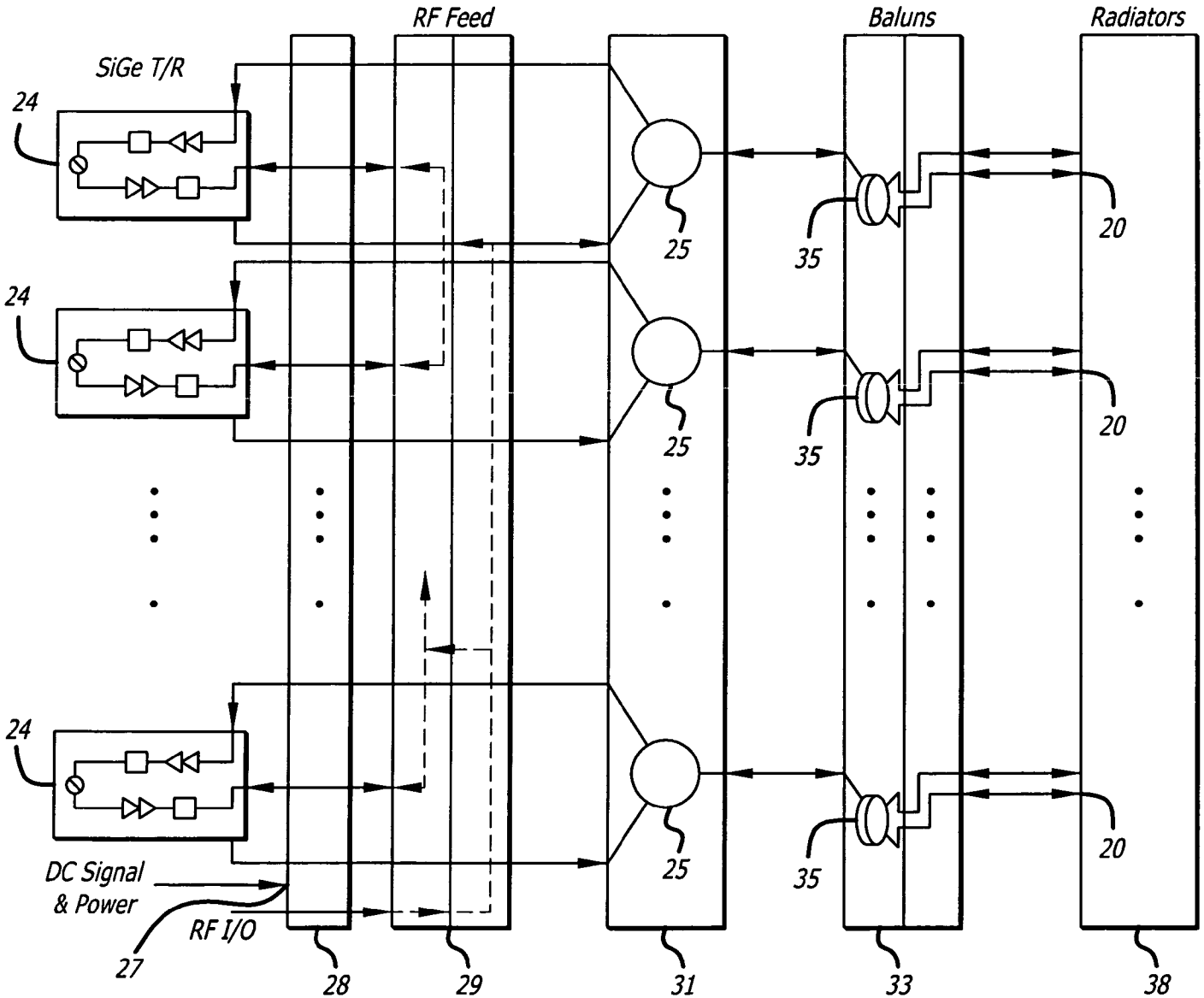
FIG. 7 is a block diagram of an illustrative embodiment of a communication system adapted for use with the helmet-mounted phased array antenna of the present teachings.

FIG. 7 is a block diagram of an illustrative embodiment of a communication system adapted for use with the helmet-mounted phased array antenna of the present teachings. In FIG. 7, five separate layers are shown 28, 29, 31, 33 and 38, each. consisting of multiple lamina. Those of ordinary skill in the art will appreciate that the present invention is not limited to the number of layers used or the lamination thereof. Although the arrangement is shown flat, it should be understood that the layers may be conformal to suit the shape of the platform used in the chosen application. In the illustrative embodiment, the layers are conformal to a helmet. For a helmet application, the phased array should be shaped so that a beam may be steered in any direction, e.g. where another transponder may be located, such as a satellite or communications tower.

Plural conventional transmit/receive (T/R) modules 24 are provided, each having amplifiers and phase shifters for agile beam steering with digital/analog control as is common in electronically scanned phased array antenna art. Each module or chip 24 receives power from and routes data through a first conformal layer 28 to which direct current signals and power are provided via an external port 27. The second conformal layer 29 effects radio frequency (RF) routing between the modules 24 and a plurality of associated diplexer/switches 25 disposed in the third conformal layer 31.

Balancing and impedance matching elements are coupled to the resonant cavities on one end thereof and disposed in a fourth conformal layer 33. The baluns and impedance matching elements 35 in the fourth layer 33 are coupled to associated radiating elements 44 disposed in the fifth conformal layer 38.

Beam steering is effected by a beam controller (not shown) with beam steering logic therein, which controls the relative phase of radiation for each element.

Hence, in the illustrative application, the present invention addresses the problem of soldier communications connectivity by having a lightweight phased array antenna mounted inside, outside, or within a soldier's helmet that conforms to the dome-shape of the helmet itself. By being inside the helmet, a beam-steerable high-gain antenna is provided to the soldier that can operate whether the soldier is moving or stationary, in virtually any natural position of a soldier, whether squatting, bent over or lying on his front side. A line of sight path can be provided from the helmet to transceiver, thereby providing the possibility of direct or indirect satellite connectivity in almost any bodily position of the soldier. The conformal shape of the phased array is ideal in providing hemispherical scanning ability of the antenna. Its location inside the helmet, which is typically designed to prevent penetration by a small-arms projectile, also provides some level of ruggedness to the antenna. And the Kevlar construction of modern helmets provides an ideal dielectric for the antenna. The close proximity of the antenna to the soldier's head provides mechanisms to integrate microphone and speaker with the antenna inside into a single system.

Thus, the present invention has been described herein with reference to a particular embodiment for a particular application. Those having ordinary skill in the art and access to the present teachings will recognize additional modifications, applications, and embodiments within the scope thereof. For example, those skilled in the art will appreciate that the invention is not limited to military applications. The present teachings may be extended to other helmets including those used by construction workers, safety personnel, athletes, etc. Further, the inventive antenna may be used in flat, nonconformal communications applications such as for cellular telephony.

Additionally, the present invention enables independent transmit and receive phase angle control, allowing antenna to receive from one direction and transmit in another direction.

It is therefore intended by the appended claims to cover any and all such applications, modifications and embodiments within the scope of the present invention.

Accordingly,

What is claimed is:

1. An antenna comprising:

a substrate; and an array of radiating elements disposed on said substrate, each of said elements including:

a resonant cavity formed between a ground plane and a layer of metallization having a radiating slot;

a first layer of dielectric material disposed within said cavity; and a means for feeding said cavity with an electromagnetic signal.

2. The invention of claim 1 wherein said means for feeding includes a microstrip feed disposed on said layer of dielectric material.

3. The invention of claim 2 wherein said microstrip feed is parallel to a plane of a portion of said substrate over which an associated element is disposed.

4. The invention of claim 1 further including a layer of foam disposed between said layer of dielectric material and said ground plane.

5. The invention of claim 4 further including second and third parallel layers of dielectric material, said second layer being disposed adjacent to said ground plane.

6. The invention of claim 5 further including a layer of element interconnection paths disposed between said second and third layers of dielectric material.

7. The invention of claim 6 further including a transmit/receive module or each element secured to said third layer of dielectric material.

8. The invention of claim 1 further including a transmit/receive module for each element.

9. The invention of claim 1 further including means for selectively exciting said elements.

10. The invention of claim 1 further including means for bonding said antenna to a helmet.

11. The invention of claim 10 wherein said helmet is constructed with Kevlar.

12. The invention of claim 1 wherein said substrate is flexible.

13. The invention of claim 1 wherein said substrate is rigid.

14. The invention of claim 1 further including means for transmitting or receiving a beam with linear or circular polarization.

15. The invention of claim 14 wherein receive and transmit beams may be independently steered.

16. The invention of claim 1 wherein said substrate is conformed to a shape of a helmet.

* * * * *